US006009597A

United States Patent [19]

Yu

[11] Patent Number: 6,009,597

[45] Date of Patent: Jan. 4, 2000

[54] BUFFER DEVICE OF DOOR

[76] Inventor: King-Sung Yu, Chang Hwa Hsien, Taiwan

[21] Appl. No.: 09/075,397

[22] Filed: May 11, 1998

[51] Int. Cl.[7] ..... E05F 5/00

[52] U.S. Cl. ..... 16/85; 292/DIG. 15

[58] Field of Search ..... 16/85, 86 R, 86 A, 16/86 B; 49/137; 292/DIG. 15, 338; 267/175, 177

[56] References Cited

U.S. PATENT DOCUMENTS

| | | | |
|---|---|---|---|
| 1,592,912 | 7/1926 | Thompson | 16/85 |
| 2,207,128 | 7/1940 | Lasior | 16/49 |
| 2,735,132 | 2/1956 | Wartian | 16/52 |
| 2,762,641 | 9/1956 | Gilmour | 292/338 |
| 3,039,757 | 6/1962 | Barr | 267/140 |
| 3,986,742 | 10/1976 | Heaney | 292/268 |
| 4,419,786 | 12/1983 | Sukuro, Jr. | 16/51 |
| 4,625,417 | 12/1986 | Cusak | 33/169 R |
| 5,446,944 | 9/1995 | Coleman et al. | 16/85 |
| 5,448,797 | 9/1995 | Coleman | 16/85 |
| 5,448,798 | 9/1995 | Coleman et al. | 16/85 |
| 5,802,671 | 9/1998 | Ikuma | 16/85 |
| 5,895,089 | 4/1999 | Singh et al. | 296/207 |

*Primary Examiner*—Anthony Knight
*Assistant Examiner*—Alison K. Pickard
*Attorney, Agent, or Firm*—Browdy and Neimark

[57] ABSTRACT

A door buffering device is fastened with a top edge of a door frame and is composed of a seat, a confining member fastened in one end of a track of the seat, and a slide block fastened slidably in another end of the track of the seat such that the slide block is fastened with one end of a connection arm of a connection mechanism which is fastened with a top edge of the door. As the door is opened to the fullest extent, one end of a coil spring of the slide block collides with a rod of the confining member for mitigating the impetus of the slide block so as to minimize the door vibration.

6 Claims, 3 Drawing Sheets

BUFFER DEVICE OF DOOR

FIELD OF THE INVENTION

The present invention relates generally to a door, and more particularly to a buffer device of the door.

BACKGROUND OF THE INVENTION

The conventional buffer device for confining the opening of the door comprises a connection mechanism which is connected between the door and the door frame for preventing the door from being opened abruptly and widely. Such a conventional buffer device as described is defective in design in that it often fails to prevent the door from being opened rapidly at a maximum opening angle, and that the door vibration is brought about at such time when the door is opened at the maximum angle.

SUMMARY OF THE INVENTION

The primary objective of the present invention is to provide a door buffering device capable of preventing the door vibration when the door is opened at a maximum angle.

In keeping with the principle of the present invention, the foregoing objective of the present invention is attained by a door buffering device consisting of a seat, a confining member, a slide block, a resilient member, and an adjusting member. The seat has a track for locating the confining member. The slide block is slidably located in the track and is provided with a receiving cell in which the resilient member is confined such that the resilient member is corresponding in location to a round rod of the confining member. The adjusting member is movably disposed in the receiving cell such that the adjusting member is in contact with the resilient member. The slide block is fastened pivotally with a connection mechanism which is fastened with the door. As the slide block collides with the confining member, the protruded portion is impacted by one end of the resilient member for mitigating the impact force of the slide block.

DETAILED DESCRIPTION OF THE INVENTION

Figure 1:
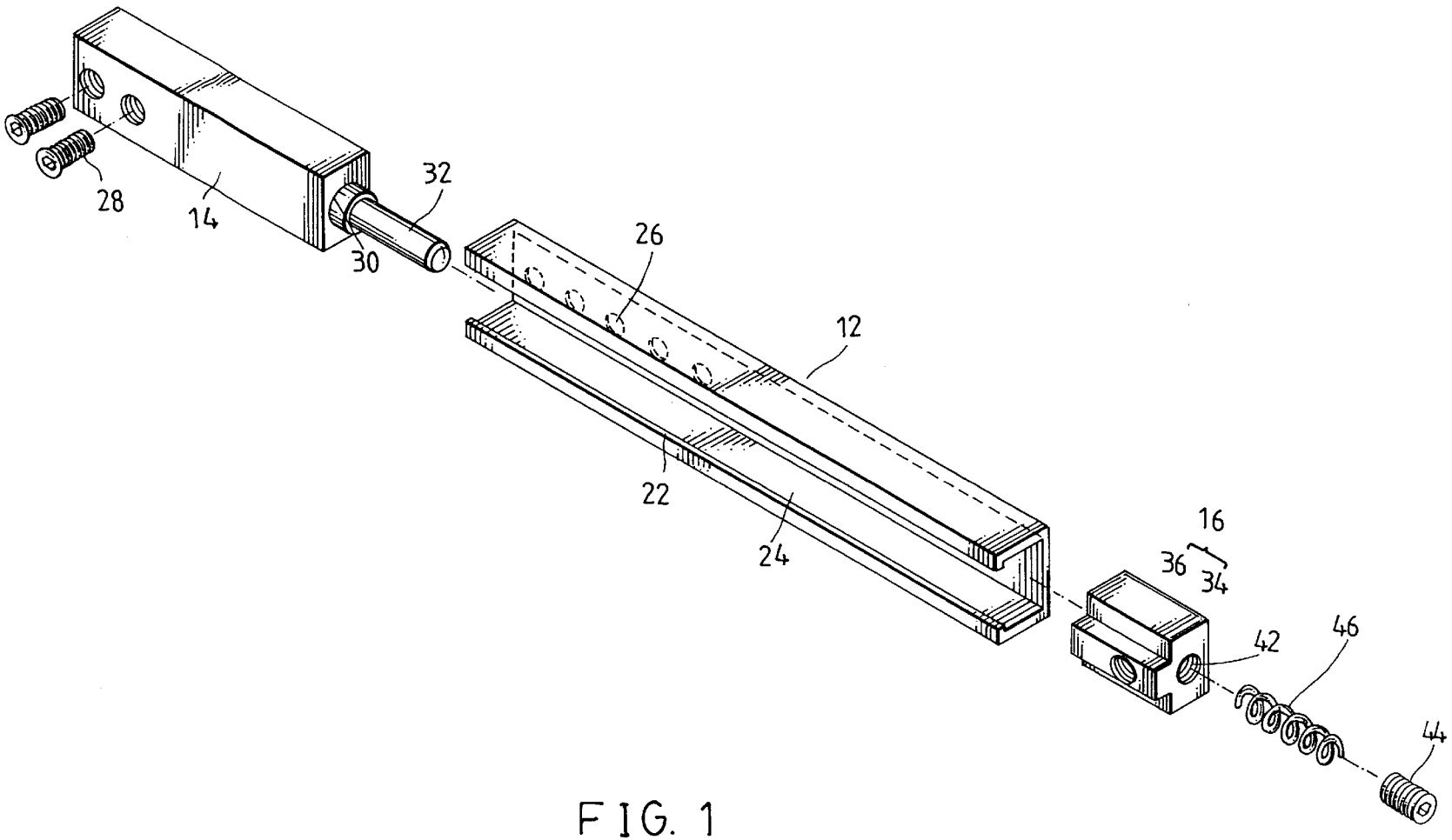
FIG. 1 shows an exploded view of the present invention.
Figure 2:
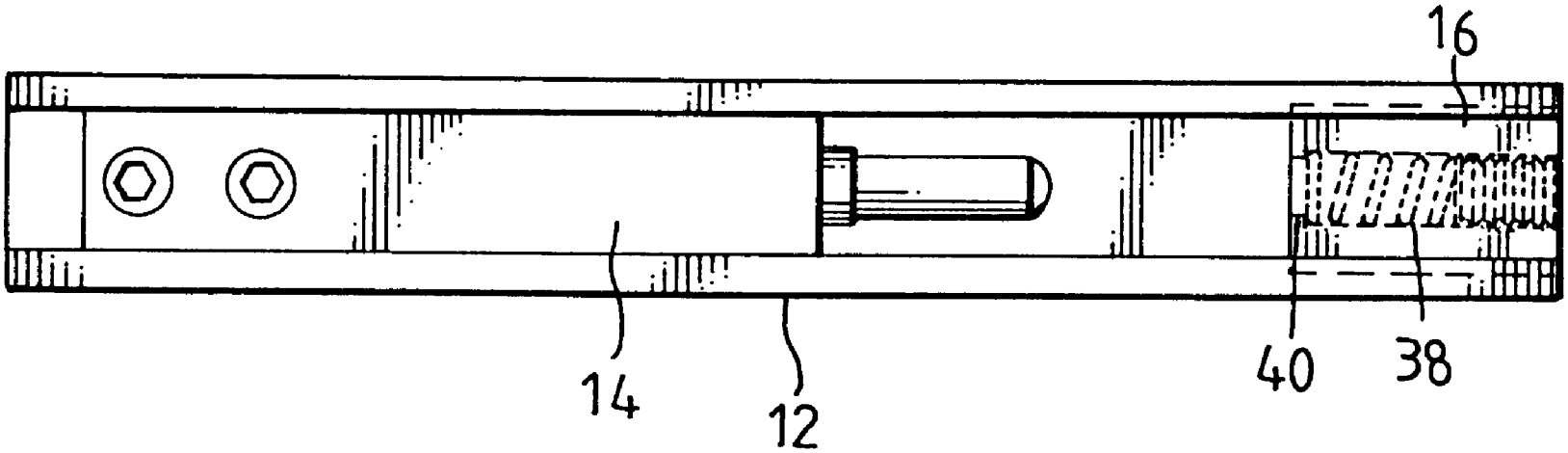
FIG. 2 shows a schematic view of the present invention in combination.

As shown in FIGS. 1 and 2, a door buffering device 10 embodied in the present invention is composed of a seat 12 which is provided with an open longitudinal side 22 and a track 24 for locating a confining member 14. A slide block 16 is movably disposed in the track 24. Located in a longitudinal side opposite to the open longitudinal side 22 are a plurality of first locating portions (slots) 26. The confining member 14 is provided with two second locating portions (bolts) 28, which are engaged with the first locating portions 26 of the seat 20 for locating the confining member 14 at a position in the track 24. The confining member 14 is provided at one longitudinal end thereof with a blind hole 30 for locating one end of a round rod 32 which has a conical free end. The slide block 16 has a base 34 and a protruded portion 36. The base 34 is provided with a receiving cell 38 coaxial with the round rod 32 and having a stopping edge 40 corresponding in location to the inner edge of one end of the round rod 32. The round rod 32 is capable of passing through the stopping edge 40. The receiving cell 38 is provided with an inner threaded portion 42 corresponding to inner edge of another end of the round rod 32 for engaging an adjusting member 44 (a sunken head screw). A resilient member 46, which is a coil spring, is located in the receiving cell 38 such that the coil spring 46 is located between the adjusting member 44 and the stopping edge 40, and that the tension of the coil spring 46 can be adjusted by changing the position of the adjusting member 44. The coil spring 46 has an outer diameter greater than the inner diameter of the stopping edge 40. The coil spring 46 has an inner diameter smaller than the inner diameter of the stopping edge 40.

Figure 3:
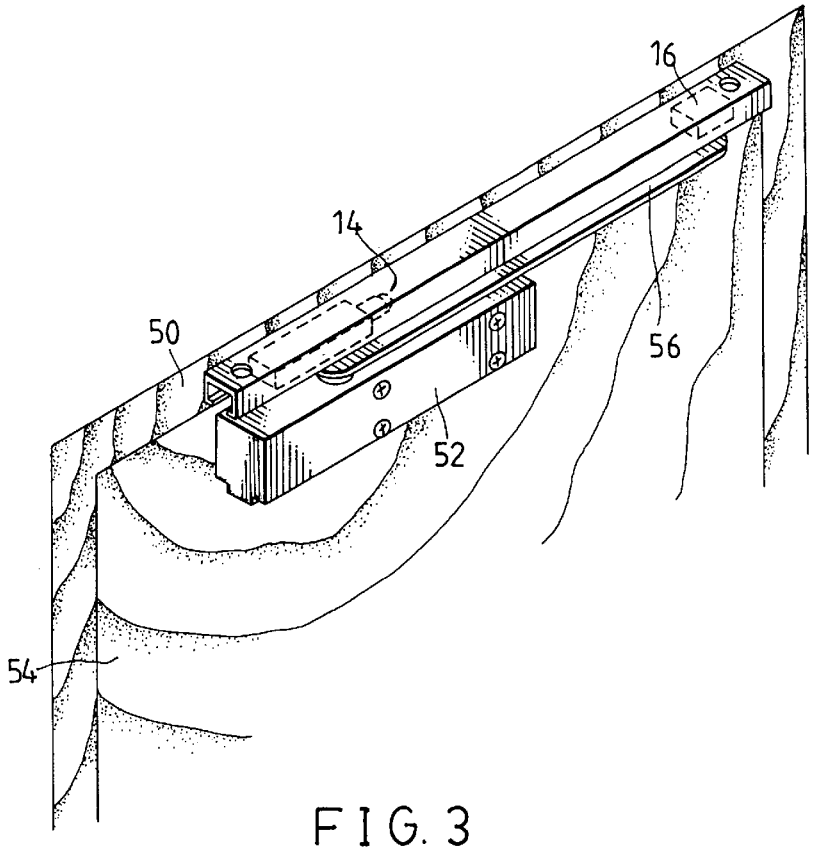
FIG. 3 shows a schematic view of the present invention fastened with a door frame.
Figure 4:
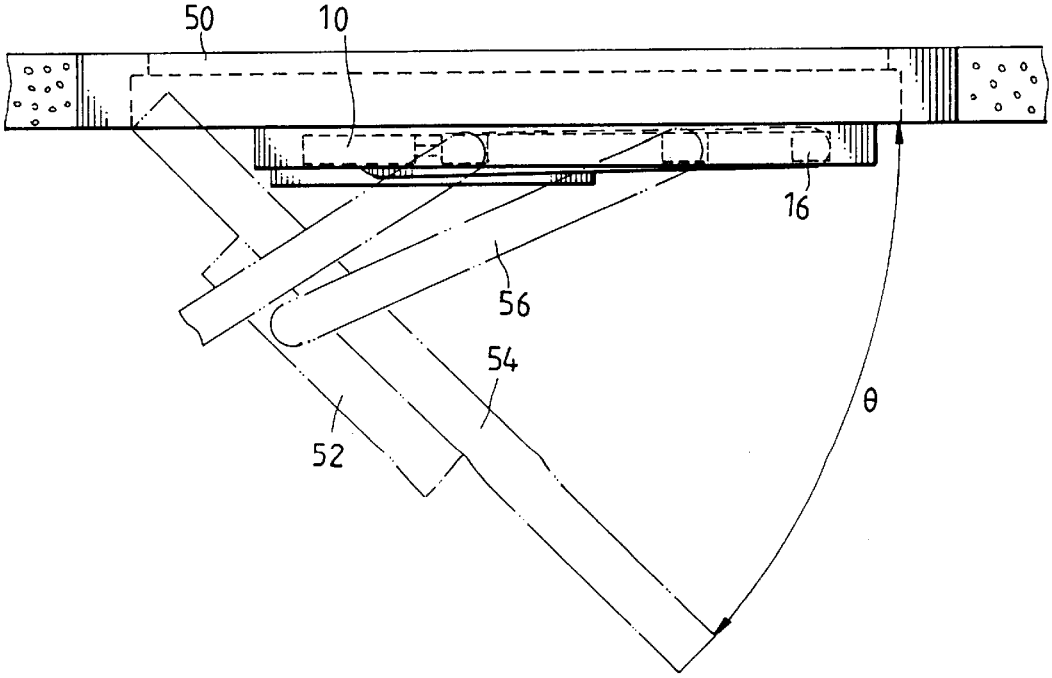
FIG. 4 shows a schematic view of the present invention at work.

As illustrated in FIGS. 3 and 4, the door buffering device 10 of the present invention is fastened with a door frame 50 such that the open longitudinal side 22 faces the floor, and that the slide block 16 is fastened with a connection arm 56 of a connection mechanism 52 which is fastened with the upper edge of a door 54. When the door 54 is pulled, the slide block 16 is pulled by the connection arm 56 to move toward the confining member 14. As the door 54 is pulled continuously such that the door 54 is opened at a maximum angle, one end of the coil spring 46 is in a soft colliding with the free end of the round rod 32 of the confining member 14. The tension of the coil spring 46 serves to buffer the impetus brought about at the time when the door 54 is opened, thereby preventing the vibration of the door 54. The magnitude of tension of the coil spring 46 is dependent on the weight of the door 54.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A door buffering device comprising:

a seat fastened with a top edge of a door frame and provided therein with a track extending along the direction of a longitudinal axis of said seat;

a confining member located adjustably in one end of said track of said seat and provided at one end thereof with a rod fastened therewith; and a slide block located slidably in another end of said track of said seat and provided with a receiving cell extending along the direction of a longitudinal axis of said slide block such that said receiving cell is coaxial with said rod of said confining member, said receiving cell provided therein with a resilient member and an adjusting member for adjusting tension of said resilient member, said slide block being fastened with one end of a connection arm of a connection mechanism which is fastened with a top edge of a door, such that said slide block is capable of being driven by said connection arm to slide in said track toward said confining member at such time when the door is opened, and further that one end of said resilient member collides with said rod of said confining member at such time when the door is opened to a fullest extent.

2. The door buffering device as defined in claim 1, wherein said track of said seat is provided in one end thereof with a plurality of locating portions; and wherein said confining member is provided with a plurality of locating portions corresponding in location to and engageable with said locating portions of said track.

3. The door buffering device as defined in claim 1, wherein said receiving cell of said slide block is provided in an inner wall thereof with a stopping edge; and wherein said resilient member is located between said stopping edge and said adjusting member.

4. The door buffering device as defined in claim 1, wherein said receiving cell of said slide block is provided in an inner wall of one end thereof with an inner threaded portion; and wherein said adjusting member is engaged with said inner threaded portion of said receiving cell.

5. The door buffering device as defined in claim 4, wherein said adjusting member is a sunken head screw.

6. The door buffering device as defined in claim 1, wherein said resilient member is a coil spring.

* * * * *